US011920426B2

(12) United States Patent
Thomason

(10) Patent No.: US 11,920,426 B2
(45) Date of Patent: Mar. 5, 2024

(54) PAYLOAD DEPLOYMENT TOOLS

(71) Applicant: John Tyler Thomason, Austin, TX (US)

(72) Inventor: John Tyler Thomason, Austin, TX (US)

( * ) Notice: Subject to any disclaimer, the term of this patent is extended or adjusted under 35 U.S.C. 154(b) by 69 days.

(21) Appl. No.: 17/069,909

(22) Filed: Oct. 14, 2020

(65) Prior Publication Data

US 2022/0112786 A1 Apr. 14, 2022

(51) Int. Cl.

*E21B 34/06* (2006.01)
*E21B 27/00* (2006.01)
*E21B 47/11* (2012.01)

(52) U.S. Cl.

CPC ..... *E21B 34/063* (2013.01); *E21B 27/00* (2013.01); *E21B 47/11* (2020.05)

(58) Field of Classification Search

CPC ..... E21B 34/063; E21B 47/11; E21B 43/26; E21B 27/00; E21B 27/02

See application file for complete search history.

(56) References Cited

U.S. PATENT DOCUMENTS 4,334,582 A * 6/1982 Baker ..... E21B 33/143 166/355
5,042,598 A 8/1991 Sherman
7,546,878 B2 * 6/2009 Prado ..... E21B 43/045 166/311
8,776,884 B2 * 7/2014 Xu ..... E21B 43/16 166/305.1
2007/0039741 A1 * 2/2007 Hailey ..... E21B 34/10 166/228
2008/0142225 A1 * 6/2008 Prado ..... E21B 43/25 166/278
2008/0223587 A1 * 9/2008 Cherewyk ..... E21B 33/068 166/69
2010/0236781 A1 9/2010 Mytopher et al.
2011/0042081 A1 * 2/2011 Streich ..... C09K 8/42 166/269
2012/0118564 A1 * 5/2012 Gomes ..... E21B 47/26 166/250.12
2012/0267119 A1 10/2012 Patel
2016/0208575 A1 * 7/2016 Bellavance ..... E21B 34/063
2018/0135381 A1 * 5/2018 Tolman ..... E21B 43/116

(Continued)

FOREIGN PATENT DOCUMENTS

GB 2457285 A 8/2009
WO WO 9206271 A1 * 4/1992 ..... E21B 21/08

(Continued)

OTHER PUBLICATIONS

International Search Report and Written Opinion in International Application No. PCT/US2021/0071822, dated Feb. 24, 2022.

*Primary Examiner* — Theodore N Yao

(74) *Attorney, Agent, or Firm* — Taylor English Duma LLP

(57) ABSTRACT

A payload deployment tool is provided. The tool includes a housing having a coupler configured to couple to a fluid delivery conduit; a pressure chamber in communication with the coupler; a plurality of payload chambers in communication with the pressure chamber, each of the payload chambers having an upstream opening and a downstream opening; and a plurality of upstream pressure-rupturable seals respectively covering the upstream openings.

10 Claims, 7 Drawing Sheets

(56) References Cited

U.S. PATENT DOCUMENTS

| | | | | |
|---|---|---|---|---|
| 2020/0283678 | A1* | 9/2020 | Ogle | C09K 8/88 |
| 2021/0047903 | A1* | 2/2021 | Albert | E21B 43/119 |
| 2021/0254421 | A1* | 8/2021 | Tonti | E21B 43/28 |
| 2021/0372217 | A1* | 12/2021 | Lende | E21B 33/13 |
| 2021/0388691 | A1* | 12/2021 | Barker | E21B 43/26 |

FOREIGN PATENT DOCUMENTS

| | | | | |
|---|---|---|---|---|
| WO | 2011023943 | A2 | 3/2011 | |
| WO | WO-2020239649 | A2 * | 12/2020 | E21B 34/08 |

* cited by examiner

PAYLOAD DEPLOYMENT TOOLS

The subject disclosure relates generally to tools and methods for use in crude oil and natural gas production wells, and more specifically, to payload deployment tools and methods for selectively discharging desired payloads into oil and gas wells.

BACKGROUND OF THE DISCLOSURE

Energy companies, such as fracturing companies, strive to achieve an understanding of the heterogeneity of targeted reservoir rock both vertically and horizontally, including, for example, a variation of rock properties along a wellbore. Achieving such an understanding is of great importance, as rock heterogeneity is highly variable and has the potential to negatively affect the performance of a well.

Unfortunately, typical survey and scientific methods have proven ill-suited to obtain an adequate understanding of reservoir heterogeneity, as rock layers are deposited over millions of years with lithologic and structural variations that are difficult to detect using low-resolution 3D seismic or scanning gamma ray tools. Well operators, instead, rely on suboptimal technologies that discover rock properties and other data points affecting well performance as (or after) the wells themselves are drilled and operating (i.e., at times when substantial resources have already been devoted to planning and drilling). While obtaining data on reservoir heterogeneity as or after a subject well is drilled may be of little value for improving performance of the subject well itself, such data may be of great value for determining placement of subsequent wells at a fracturing site and for predicting the performance of other wells (or indeed other fracturing sites) based on similarities of observable and/or detectable geological features and well characteristics.

Of particular importance, fracturing site operators typically wish to understand the density, pressure gradient and flow heterogeneity across reservoir rock, as such factors typically affect the efficiency of hydrocarbon extraction across a fracturing site (which may contain multiple fracturing wells). For example, hydrocarbon extraction from low-pressure portions of reservoir rock in a parent well may be negatively affected by fracturing of a child well (i.e., a well formed after the parent well) drilled nearby, as high-pressure fracturing fluid injected into the child well may propagate across the reservoir rock to low-pressure portions of the parent well. This hydraulic communication hinders stimulation of the child well and floods the parent well with fracturing fluid, thereby degrading performance of both wells. A prior understanding of rock densities, pressure gradients and flow characteristics would allow fracturing site operators to avoid these issues by better planning the fracturing site, for example, to reduce negative interactions between and among wells.

To obtain a better understanding of the density and pressure gradient heterogeneity across reservoir rock, as well as other attributes of rock heterogeneity, fracturing site operators measure the pressure of particular sections of a fracturing wellbore (also known as fracturing stages). Pressure at a fracturing stage may be measured, for example, by analyzing the decay rate of the initial instantaneous shut in pressure (ISIP) of fracturing fluid immediately after pumping the fluid into the stage. A higher decay rate may be indicative of highly porous (i.e. less dense) and/or low-pressure reservoir rock.

To measure flow characteristics, a unique chemical marker is mixed with the fracturing fluid for each stage.

During the fracturing process, the chemical marker embeds within the rock formation. The stage is then sealed using a composite "plug." Each subsequent stage is then fractured using a different and unique chemical marker. After all stages are fractured, the plugs are drilled (or removed) to allow hydrocarbon extraction from all stages at the same time. As the hydrocarbons are extracted, they flow with the chemical markers that were pumped, causing them to leach into the flow. Site operators then measure amounts of the different chemical markers in the extracted hydrocarbons to better understand the flow characteristics of each stage (with better performing stages resulting in higher measured amounts of their associated chemical markers).

While this process allows well site operators to gain valuable information concerning flow at individual fracturing stages, the limited availability of unique and suitable chemical markers (approximately 60 currently available) limits its effectiveness, especially in view of recent advances in fracturing technologies that permit an ever increasing number of stages per well. The process is further limited, as the chemical markers tend to leach into and contaminate adjacent wells, thereby limiting the ability of operators from using the same chemical markers to measure flow characteristics of different wells at the same fracturing site.

BRIEF SUMMARY OF THE DISCLOSURE

Various embodiments of the subject disclosure provide payload deployment tools that help energy companies and site operators reliably understand the heterogeneity of reservoir rock both vertically and horizontally. The payload deployment tools are cost effective, easy to use, do not substantially contaminate the reservoir with traceable chemicals, and allow for production tests of sufficient duration to ascertain the productivity of various stages of a hydrocarbon well.

In accordance with an exemplary embodiment of the subject disclosure, a payload deployment tool is provided. The tool includes a housing having a coupler configured to couple to a fluid delivery conduit; a pressure chamber in communication with the coupler; a plurality of payload chambers in communication with the pressure chamber, each of the payload chambers having an upstream opening and a downstream opening; and a plurality of upstream pressure-rupturable seals respectively covering the upstream openings.

In accordance with another aspect of the subject disclosure, the payload deployment tool further includes a plurality of downstream pressure-rupturable seals respectively covering the downstream openings.

In accordance with still another aspect of the subject disclosure, the coupler is threaded.

In accordance with yet another aspect of the subject disclosure each of the upstream pressure-rupturable seals has a unique pressure rating.

In accordance with still another aspect of the subject disclosure, each of the downstream pressure-rupturable seals has a pressure rating lower than all of the pressure ratings of the upstream pressure-rupturable seals.

In accordance with yet another aspect of the subject disclosure, each of the payload chambers extends parallel to a longitude of the tool.

In accordance with still another aspect of the subject disclosure, each of the payload chambers extends laterally with respect to a longitude of the tool.

In accordance with yet another aspect of the subject disclosure, the payload deployment tool further includes a fluid passage in communication with the pressure chamber.

In accordance with still another aspect of the subject disclosure, the fluid passage extends longitudinally from the fluid chamber to a distal end of the housing.

In accordance with yet another aspect of the subject disclosure, the payload deployment tool further includes a plurality of payloads respectively positioned within the plurality of payload chambers.

In accordance with still another aspect of the subject disclosure, each of the payloads includes a unique chemical marker.

In accordance with yet another aspect of the subject disclosure, each of the payloads includes a dissolvable material.

In accordance with another exemplary embodiment of the subject disclosure, a payload deployment tool is provided. The tool includes a housing having a coupler configured to couple to a fluid delivery conduit; a pressure chamber in communication with the coupler; a payload chamber in communication with the pressure chamber and having an upstream opening and a downstream opening; and an upstream pressure-rupturable seal configured to cover the upstream opening of the payload chamber;

In accordance with still another embodiment of the subject disclosure, a method of operating a payload deployment tool is provided. The method includes providing a payload deployment tool, including a housing having a coupler configured to couple to a fluid delivery conduit, a pressure chamber in communication with the coupler, a plurality of payload chambers in communication with the pressure chamber, each of the payload chambers having an upstream opening and a downstream opening, a plurality of upstream pressure-rupturable seals respectively covering the upstream openings, each of the upstream pressure-rupturable seals having a unique pressure rating, a plurality of downstream pressure-rupturable seals respectively covering the downstream openings, and a plurality of payloads respectively positioned within the plurality of payload chambers, attaching a fluid conduit to the coupler of the payload deployment tool; operating a fluid source to pump a fluid into the fluid conduit; lowering the payload deployment tool into a well to a first stage of the well; raising a pressure of the fluid to a level sufficient to rupture a first one of the upstream pressure-rupturable seals covering a first one of the payload chambers to deploy a first one of the plurality of payloads into the well; moving the payload deployment tool to a second stage of the well; inserting a sphere within the fluid conduit to seal the first one of the payload chambers; and raising a pressure of the fluid to a level sufficient to rupture a second one of the upstream pressure-rupturable seals covering a second one of the payload chambers to deploy a second one of the plurality of payloads into the well.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
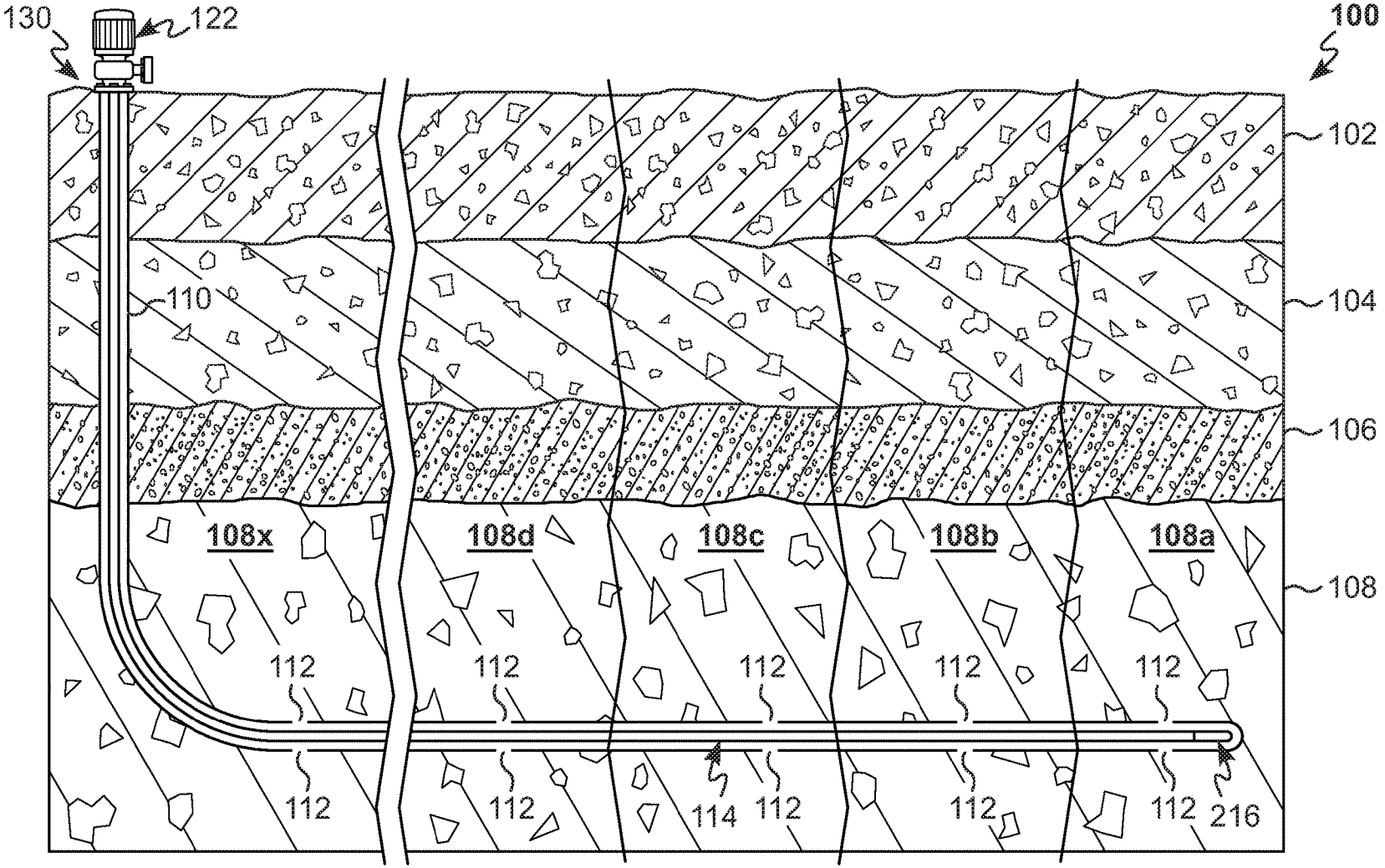
FIG. 1 is an elevational cross-section view of a horizontal well in which is deployed a payload deployment tool in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

"Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Referring now to FIG. 1, there is shown a rock formation 100 to be fractured. The rock formation 100 includes a plurality of rock strata 102, 104, 106 and 108, wherein stratum 108 is a crude oil and/or natural gas producing reservoir rock. The rock strata of FIG. 1 are not drawn to scale and a typical rock formation will include several additional strata ranging in thickness from less than one foot to 500 feet in thickness. By way of example, but not limitation, stratum 108 may range from about 3 to 30 feet in thickness. As will be discussed in greater detail herein, stratum 108 is divided into a plurality of contiguous horizontally adjacent crude oil and/or natural gas producing segments or stages 108*a*, 108*b*, 108*c*, 108*d*, . . . 108*x*.

A fracturing well 130 is also shown. Well 130 includes a wellbore 110 formed through the rock strata starting essentially vertically in upper strata, gradually bending in a large radius of curvature through intermediate strata and then horizontally in the targeted crude oil and/or natural gas bearing stratum, e.g. stratum 108. Wellbore 110 is then encased with cement. After the cement has cured, a perforation gun detonates charges through the casing and cement at selected locations to create perforations 112 in the casing at multiple fracturing stages 108*a*, 108*b*, 108*c*, 108*d*, . . . 108*x* within stratum 108. Thereafter, fracturing fluid is pumped into wellbore 110, through the perforations and into the surrounding rock. As is known, the fracturing fluid typically contains water, other chemicals and proppant material, such as sand or ceramic beads, to keep the rock open during the extraction of hydrocarbons from wellbore 110. In addition to equipment (not shown) at the well entrance to wellbore 110 for pumping the fracturing fluid, a fluid source 122 is also provided at the entrance. Fluid source 122 includes pumping equipment for pumping a separate pressurized fluid through fluid delivery conduit 114 (which may be coiled or alternatively constructed from jointed pipe sections) to a payload deployment tool 216, in accordance with an embodiment of the subject disclosure. As more fully described herein, payload deployment tool 216 is operable to controllably deliver one or more payloads to the interval across selected stages 108*a*, 108*b*, 108*c*, 108*d*, . . . 108*x* in response to the pressurized fluid provided by fluid source 122. Though payload deployment tool 216 is described herein for use in fracturing, it should be appreciated that tool 216 and other exemplary payload deployment tool 216 according to the subject disclosure may be used in connection with other manners of hydrocarbon extraction.

Figure 2B:
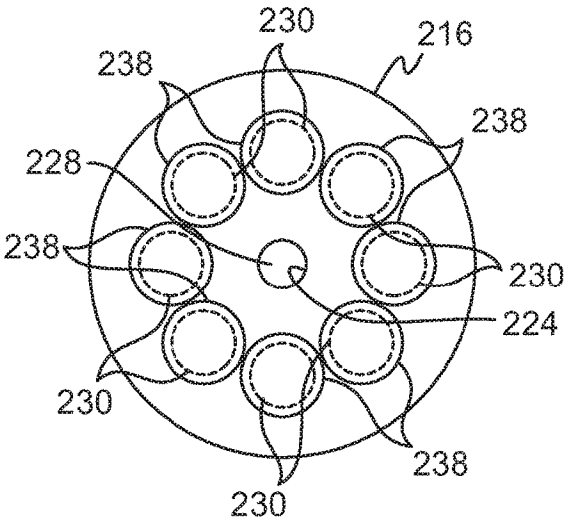
FIG. 2B is an end view of the payload deployment tool of FIG. 2A.
Figure 2A:
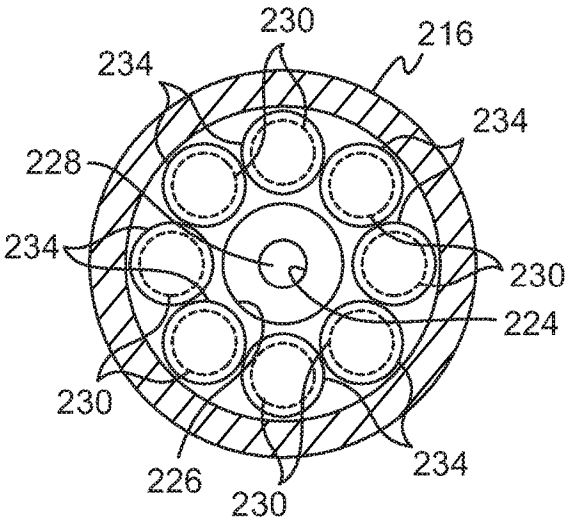
FIG. 2A is a cross-sectional view of a first embodiment of a payload deployment tool in accordance with the subject disclosure
Figure 2C:
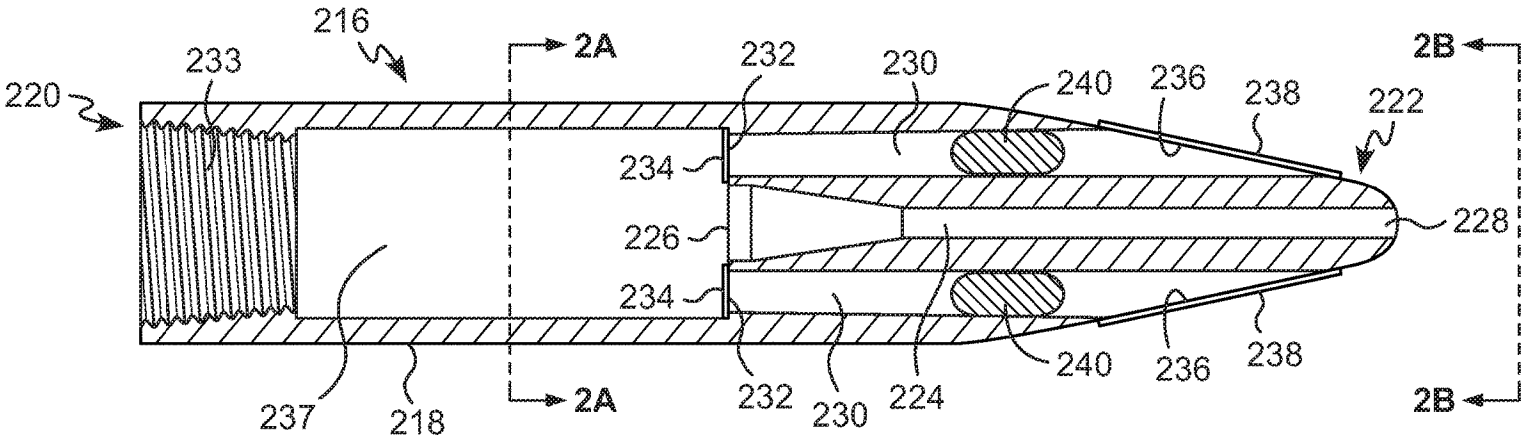
FIG. 2C is longitudinal-sectional view of the payload deployment tool of FIG. 2A.
Figure 2D:
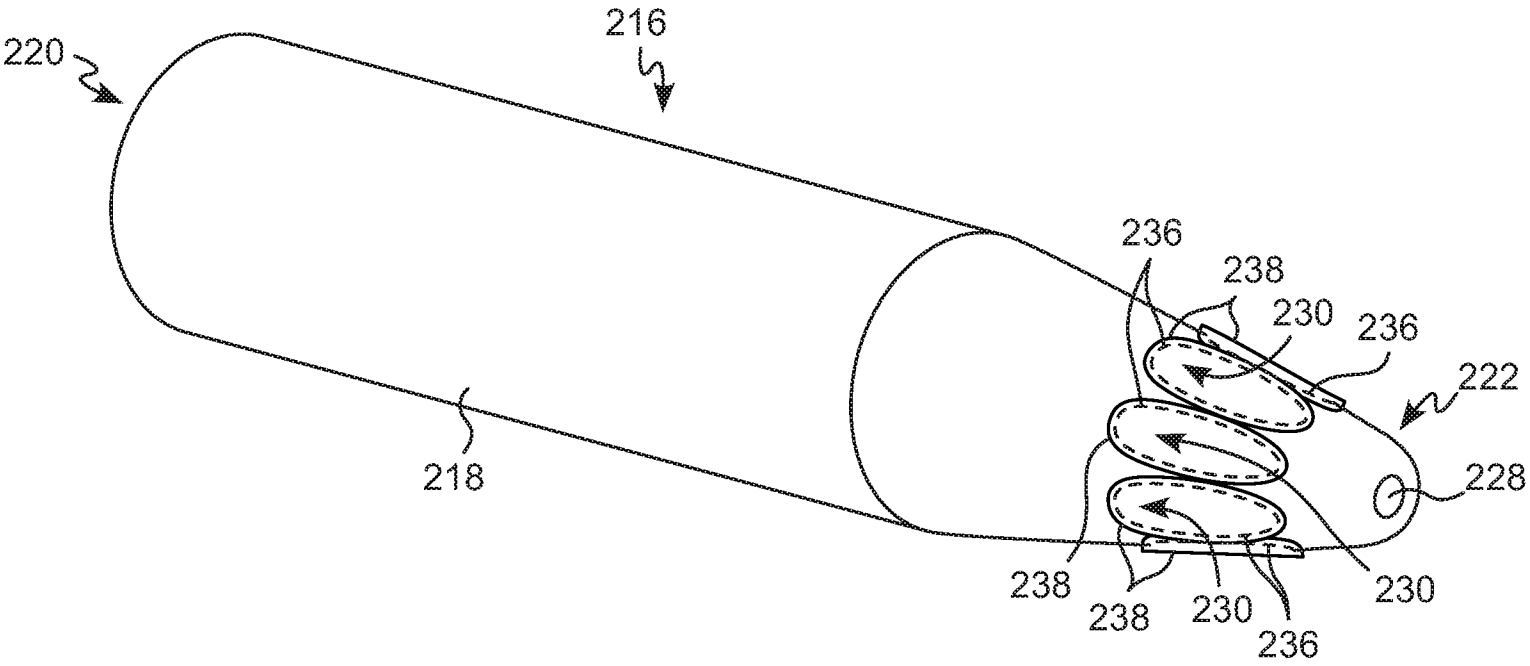
FIG. 2D is a perspective view of the payload deployment tool of FIG. 2A.

Referring now to FIGS. 2A through 2C, there is shown a payload deployment tool 216 in accordance with an embodiment of the subject disclosure. Payload deployment tool 216 includes a housing 218 having proximal and distal ends 220, 222, a coupler 233 at proximal end 220 and configured for attachment, e.g., threaded attachment, to a fluid delivery conduit (such as conduit 114 of FIG. 1), a pressure chamber 237 in communication with coupler 233, a fluid passage 224 in communication with pressure chamber 237 and extending longitudinally from proximal end 220 to distal end 222 between a proximal inlet 226 with a ball seat and a distal outlet 228 for allowing fluids to pass through tool 216, a plurality of payload chambers 230 in communication with pressure chamber 237 and disposed about and extending substantially parallel to fluid passage 224, and payloads 240 positioned respectively within payload chambers 230. Although payload deployment tool 216 includes eight payload chambers 230 and payloads 240, it should be appreciated that any number of chambers 230 may be employed, and that various embodiments of the subject disclosure are not intended to be limited to any particular number or arrangement of chambers 230.

Each payload chamber 230 comprises upstream and downstream openings 232, 236 covered respectively by upstream and downstream pressure-rupturable seals 234, 238 (or rupture disks) (see FIGS. 2A, 2B). Upstream pressure-rupturable seals 234 have respective and unique pressure ratings, in that each is designed to rupture upon application of a unique pressure or non-overlapping range of pressures, whereas all downstream pressure-rupturable seals 238 have the same pressure rating, such as, for example, a pressure rating less than those of upstream pressure-rupturable seals 234. It should be appreciated, however, that each downstream pressure-rupturable seal 238 may be designed to rupture at a different pressure, including at pressures within or above a range of rupturing pressures of upstream pressure-rupturable seals 234, and that various embodiments of the subject disclosure are not intended to be limited to any particular pressure or pressure range. It should also be appreciated that two or more upstream pressure-rupturable seals 234 may have the same pressure rating. It should also be appreciated that, although upstream and downstream pressure-rupturable seals 234, 238 are shown in the Figures as covering upstream and downstream openings 232, 236, seals 234, 238 may be placed alternatively within openings 232, 236, for example, to ensure that the outside surfaces of seals 234, 238 are flush with associated surfaces of payload deployment tool 216 (i.e., flush with the inside surface of pressure chamber 237 immediately adjacent upstream openings 232, with respect to upstream pressure-rupturable seal 234, and flush with the outside surface of payload deployment tool 216 immediately adjacent to downstream openings 236, with respect to downstream pressure-rupturable seal 238). Alternatively, shallow recesses may be etched around upstream and downstream openings 232, 236 to a size and thickness approximately equal to that of seals 234, 238, thereby ensuring that the outside surfaces of the seals 234, 238 remain flush even when covering upstream and downstream openings 232, 236.

Pressure-rupturable seals, such as pressure-rupturable seals 234, 238, may be formed, for example, from stainless steel, carbon steel, Inconel, nickel, aluminum, tantalum, Hastelloy, graphite, and/or Monel of varying thicknesses, e.g., about 0.001 in. to about 0.1 in. in thickness. Various embodiments of the subject disclosure also contemplate the use of only upstream pressure-rupturable seals 234 without downstream pressure-rupturable seals 238. Such embodiments may be preferable, for example, when the downstream well pressure is known. With respect to these and other embodiments, a break-away structure configured to break away when acted upon by the pressurized fluid provided by fluid delivery conduit 114, such as a plastic clip or the like, may be provided within each payload chambers 230 to maintain payloads 240 within payload chambers 230 until deployment.

Payload 240 may include any object, device, structure, chemical, etc. desired to be deployed to a stage 108*a*, 108*b*, 108*c*, 108*d*, . . . 108*x* of well 130, such as, for example, data-creating devices or structures, remote control data recording devices (such as those that record audio, video, pressure, and/or temperature), diverters, soap sticks, solid chemicals to dissolve, and pressure bombs (for taking a live bottom hole pressure sample). In one embodiment, payloads 240 include hydrodynamic capsules containing chemical markers (also known as "frac tracers"), such as, for example, solid, powder, or granular chemical markers. The hydrodynamic properties of the capsules allow them to remain in place when deployed into well 130 by resisting upstream displacement when hydrocarbons, water and/or other materials flow upstream from various stages 108*a*, 108*b*, 108*c*, 108*d*, . . . 108*x* of well 130. The capsules are also structured or otherwise operable to allow the chemical markers to exit into the wellbore 110 in a controlled (or non-controlled) fashion and may be (but need not be) longer than the inside diameter of wellbore 110 to prevent proximal to distal rotation of the capsules after deployment. In one embodiment, for example, the capsules are formed integrally of one or more chemical markers and a dissolvable material such as carbon, solid polylactic acid material, and/or soap sticks (i.e., short sticks containing surfactant). When the capsules are deployed at various stages 108*a*, 108*b*, 108*c*, 108*d*, . . . 108*x* within wellbore 110, hydrocarbons, water and/or other fluids in wellbore 110 flow past the capsules, causing them to dissolve and release the chemical tracers into the flow. In another embodiment, the capsules are porous or otherwise permeable (e.g., when provided with a mesh outer material or other material) and allow chemical markers held therein to seep into the flowing fluid. In one particularly advantageous embodiment, the capsules include a substantial amount of surfactant that forms an emulsion with the flow of hydrocarbons, water and/or other fluids in wellbore 110 by comingling with molecules, such as gas molecules, in the fluid. This, in turn, reduces the overall fluid density allowing the bottom hole pressure of a previously shut-in well 130 to lift fluids out.

Figure 3B:
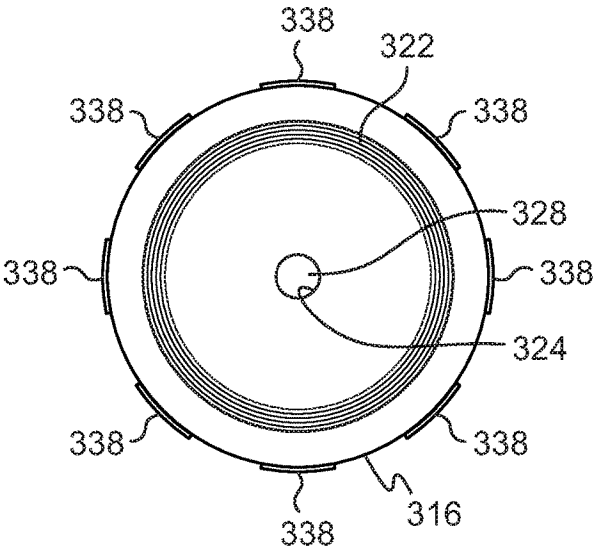
FIG. 3B is an end view of the payload deployment tool of FIG. 3A.
Figure 3A:
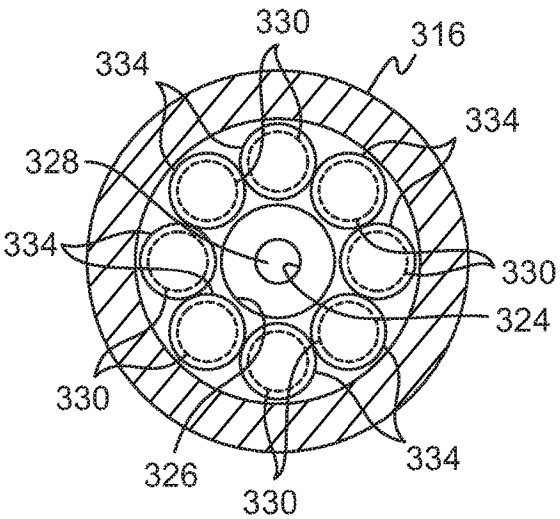
FIG. 3A is a cross-sectional view of a second embodiment of a payload deployment tool in accordance with the subject disclosure
Figure 3C:
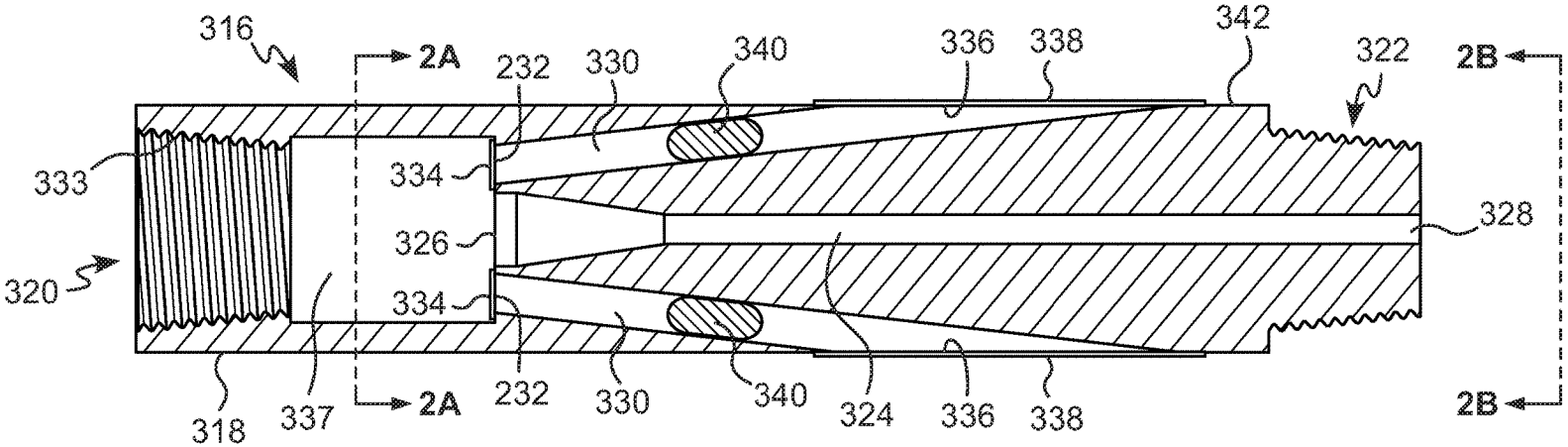
FIG. 3C is longitudinal-sectional view of the payload deployment tool of FIG. 3A.
Figure 3D:
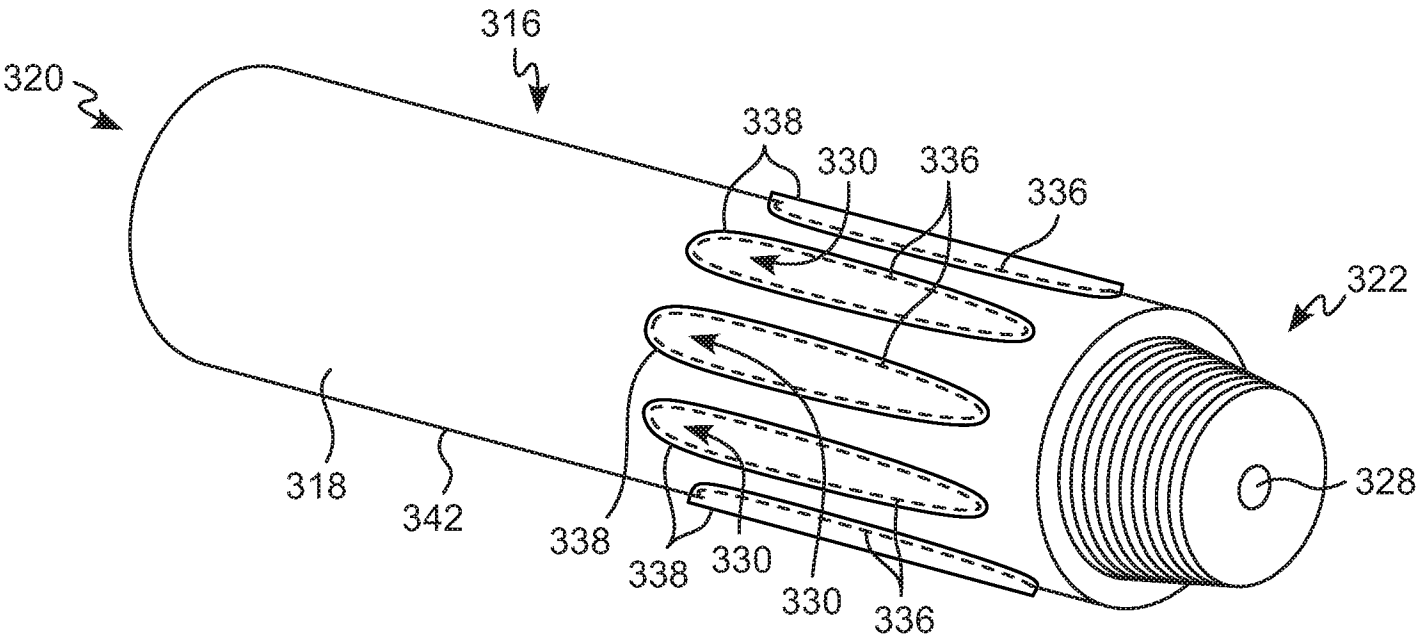
FIG. 3D is a perspective view of the payload deployment tool of FIG. 3A.

Referring now to FIGS. 3A through 3C, there is shown a payload deployment tool 316 in accordance with another embodiment of the subject disclosure. Payload deployment tool 316 includes a housing 318 having proximal and distal ends 320, 322, a coupler 333 at proximal end 320 and configured for attachment, e.g., threaded attachment, to a fluid delivery conduit (such as conduit 114 of FIG. 1), a pressure chamber 337 in communication with coupler 333, a fluid passage 324 in communication with pressure chamber 337 and extending longitudinally from proximal end 320 to distal end 322 between a proximal inlet 326 with a ball seat and a distal outlet 328 for allowing fluids to pass through tool 316, a plurality of payload chambers 330 (with upstream and downstream openings 332, 336 covered by respective rupturable-seals 334, 338) in communication with pressure chamber 337 and disposed about fluid passage 324, and payloads 340 positioned respectively within payload chambers 330. Unlike payload deployment tool 216, payload chambers 330 extend distally from upstream openings 332, diverge laterally and terminate on an outside surface 342 of tool 316. Distal end 322 is also provided with an attachment connector (which may be threaded, as shown in FIG. 3C) for coupling payload deployment tool 316 to another tool (not shown), such as, for example, a perforating tool, a plug deployment tool, etc.

A procedure for operating payload deployment tool 216 will now be described. It should be appreciated that the same or similar procedure may be employed to operate payload deployment tool 316.

To operate payload deployment tool 216 to deposit one or more payloads 240 at various stages 108*a*, 108*b*, 108*c*, 108*d*, . . . 108*x* of well 130, a well site operator first fractures well 130 and begins hydrocarbon extraction in a known manner. During the extraction (production) process (or, alternatively, during a pause in hydrocarbon extraction), payload deployment tool 216 is coupled to fluid delivery conduit 114 and lowered into wellbore 110 until tool 216 reaches the furthest stage 108*a*, 108*b*, 108*c*, 108*d*, . . . 108*x* at which a payload 240 (such as a capsule containing a chemical marker) is to be deployed. Payload deployment tool 216 travels downwardly under its own weight into the vertical section of wellbore 110, and into the horizontal section of wellbore 110 under weight of fluid delivery conduit 114. To aid transportation of payload deployment tool 216 to the desired stage 108*a*, 108*b*, 108*c*, 108*d*, . . . 108*x*, the operator controls fluid source 122 to pump pressurized fluid (such a fresh water) into fluid delivery conduit 114. The fluid, which is pressurized to a pressure less than the lowest pressure rating of upstream pressure-rupturable seals 234, flows into inlet 226 of payload deployment tool 216, through fluid passage 224, out outlet 228 and into wellbore 110, where the fluid helps reduce friction between the outside of payload deployment tool 216 and the inside casing of wellbore 110. Friction is reduced even further in wells having pressures exceeding the hydrostatic pressure of a column of the fluid having a height equal to the depth of the horizontal section of the wellbore 110, in which case the fluid ejected from payload deployment tool 216 travels upstream around the outside of tool 216 and toward the well head of well 130.

Figure 4A:
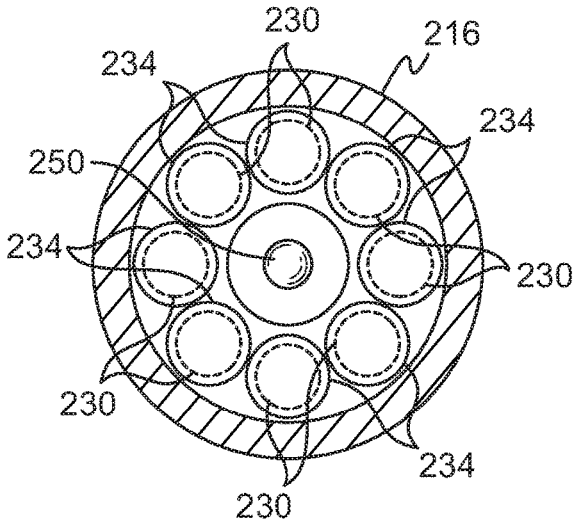
FIGS. 4A through 4E are sequential cross-sectional views of the interior of the payload deployment tool of FIG. 2A while deploying payloads.

Once payload deployment tool 216 reaches the furthest desired stage 108*a*, 108*b*, 108*c*, 108*d*, . . . 108*x*, a sphere 250, such as a metal ball bearing or the like, having a diameter larger than that of fluid passage 224, is inserted into fluid delivery conduit 114. The pressurized fluid urges sphere 250 down delivery conduit 114 and into payload deployment tool 216, where it lodges into and seals inlet 226 under pressure from the fluid (see FIG. 4A), thereby preventing the fluid from flowing through fluid passage 224 and exiting through outlet 228. It should be appreciated that sphere 250 may be replaced by differently shaped structures depending, for example, on the cross-sectional profile of inlet 216 and/or fluid passage 224, and that various embodiments of the subject disclosure are not intended to be limited to any particular shape or structure thereof.

Figure 4B:
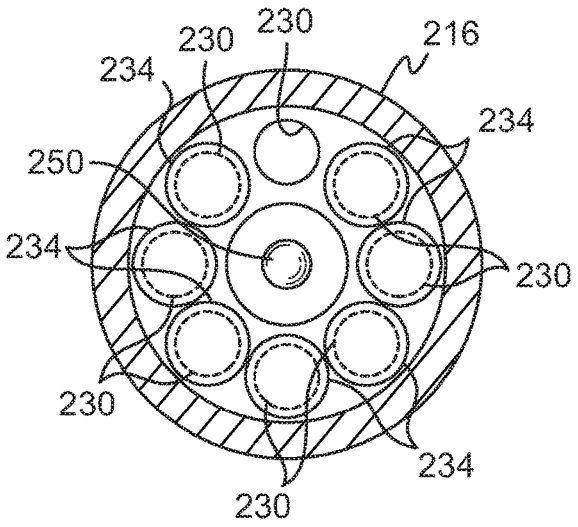

The site operator then controls the fluid source 122 to increase the pressure of the fluid to that of the lowest pressure rated upstream pressure-rupturable seal 234 of a first payload chamber 230. This causes the lowest pressure rated seal 234 to rupture (see FIG. 4B), causing the pressurized fluid to flow explosively into the first payload chamber 230 where it ruptures the associated downstream pressure-rupturable seal 238 and causes a first payload 240 to deploy through downstream opening 236 of the first payload chamber 230 and into the desired stage 108*a*, 108*b*, 108*c*, 108*d*, . . . 108*x* of wellbore 110.

The payload deployment tool 216 is then pulled proximally toward the well head via fluid delivery conduit 114 or other means to the next stage 108*a*, 108*b*, 108*c*, 108*d*, . . . 108*x* of well 130 at which another payload 240 (such as a capsule containing a different chemical marker) is to be deployed. As payload deployment tool 216 is pulled to the next stage 108*a*, 108*b*, 108*c*, 108*d*, . . . 108*x*, pressurized fluid flows freely through first payload chamber 230 and into the wellbore 110, where it aids transport of payload deployment tool 216 to the next stage 108*a*, 108*b*, 108*c*, 108*d*, . . . 108*x* by reducing friction between tool 216 and the inside casing of wellbore 110.

Figure 4C:
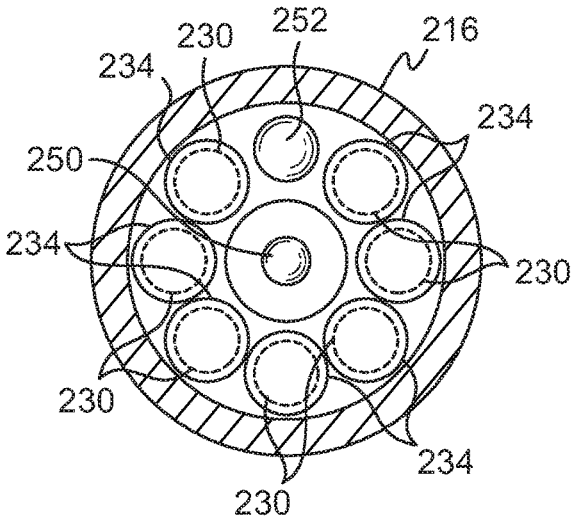

After the payload deployment tool 216 reaches the next stage 108*a*, 108*b*, 108*c*, 108*d*, . . . 108*x* (which may or may not be immediately adjacent to the stage receiving the first payload 240), a sphere 252, such as a metal ball bearing or the like, having a diameter larger than that of first payload chamber 230, is inserted into fluid delivery conduit 114. The pressurized fluid urges sphere 252 down delivery conduit 114 and into payload deployment tool 216, where it lodges into and seals upstream opening 232 of first payload chamber 230 under pressure from the fluid (see FIG. 4C), thereby preventing the fluid from flowing through first payload chamber 230 and exiting through downstream opening 236. Similar to sphere 250 for sealing fluid passage 224, sphere 252 may be replaced by differently shaped structures depending, for example, on the cross-sectional profile of upstream opening 232 and/or first payload chamber 230, and that various embodiments of the subject disclosure are not intended to be limited to any particular shape or structure thereof. It should also be appreciated that sphere 252 may be sized similarly to sphere 250 in the event that payload chambers 230 and fluid passage 224 are also sized similarly.

Figure 4D:
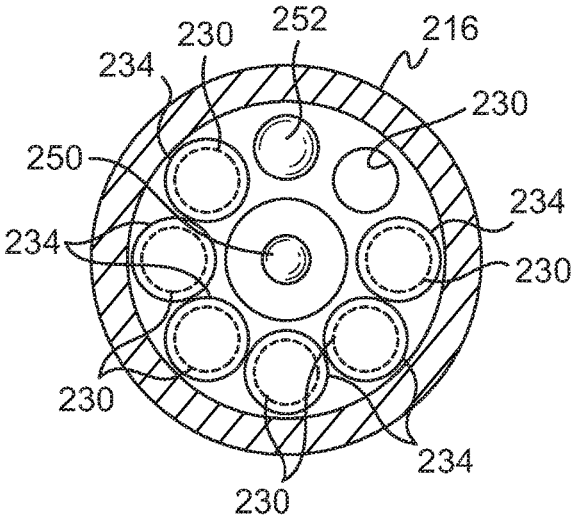

The fracturing site operator then controls the fluid source 122 to increase the pressure of the fluid to that of the second lowest pressure rated upstream pressure-rupturable seal 234 of a second payload chamber 230. This causes the second lowest pressure rated seal 234 to rupture (see FIG. 4D), causing the pressurized fluid to flow explosively into second payload chamber 230 where it ruptures the associated downstream pressure-rupturable seal 238 and causes a second payload 240 to deploy through downstream opening 236 of the second payload chamber 230 and into the next desired stage 108*a*, 108*b*, 108*c*, 108*d*, . . . 108*x* of the wellbore 110.

The payload deployment tool 216 is then again pulled proximally toward the wellhead via fluid delivery conduit 114 or other means to the next stage 108*a*, 108*b*, 108*c*, 108*d*, . . . 108*x* of well 130 at which another payload 240 (such as a capsule containing yet another different chemical marker) is to be deployed. As payload deployment tool 216 is pulled to the next stage 108*a*, 108*b*, 108*c*, 108*d*, . . . 108*x*, pressurized fluid flows freely through second payload chamber 230 and into the wellbore 110, where it aids transport of payload deployment tool 216 to the next stage 108*a*, 108*b*, 108*c*, 108*d*, . . . 108*x* by reducing friction between tool 216 and the inside casing of wellbore 110.

Figure 4E:
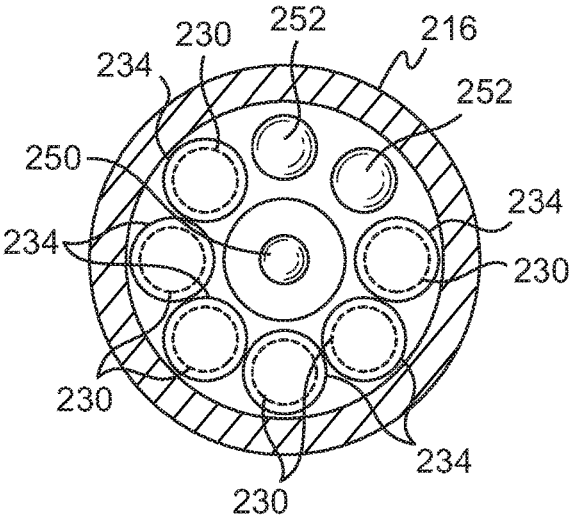

After the payload deployment tool 216 reaches the next stage 108*a*, 108*b*, 108*c*, 108*d*, . . . 108*x* (which may or may not be immediately adjacent to the stage receiving the second payload 240), a sphere 252 is inserted into fluid delivery conduit 114. The pressurized fluid urges sphere 252 down delivery conduit 114 and into payload deployment tool 216, where it lodges into and seals upstream opening 232 of second payload chamber 230 under pressure from the fluid (see FIG. 4E), thereby preventing the fluid from flowing through second payload chamber 230 and exiting through downstream opening 236.

The foregoing steps are then repeated using incrementally increasing fluid pressures to rupture successive upstream pressure-rupturable seals 234 and deploy additional payloads 240. Once all payloads 240 are deployed from their associated payload chambers 230, payload deployment tool 216 is removed from wellbore 110. To assist in removal of payload deployment tool 216, the last of payload chambers 230 may be kept open by forgoing insertion of the last sphere 252, thereby permitting the pressurized fluid to flow through the last ruptured payload chamber 230 and into wellbore 110, where it cleans wellbore 110 and helps reduce friction between the outside of payload deployment tool 216 and the inside casing of wellbore 110. Once payload deployment tool 216 is removed from wellbore 110, the site operator may continue extraction of hydrocarbons from well 130.

Since payload deployment tool 216 deposit payloads 240 containing chemical markers at discrete locations within wellbore 110, rather than into surrounding rock strata via mixing with high pressure fracturing fluid, the tool 216, as well as other embodiments of the subject disclosure, reduce the potential for chemical markers to propagate through the rock to neighboring wells, thereby reducing the chances of cross-well contamination of chemical markers. Exemplary payload deployment tools of the subject disclosure also permit the use of fewer chemical markers, as site operators are free to target only certain fracturing stages 108*a*, 108*b*, 108*c*, 108*d*, . . . 108*x* for deployment of chemical payloads.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

I claim:

1. A payload deployment tool for insertion within an inner channel of a casing string of a wellbore, the payload deployment tool comprising:

a housing sized to slide within the inner channel of the casing string, the housing including:
- an outer surface,
- a coupler,
- a pressure chamber, and
- a plurality of payload chambers downstream of the pressure chamber,
  - each of the payload chambers having an upstream opening, a downstream opening terminating about a distal end of the housing, and an upstream pressure-rupturable seal covering the upstream opening, and a downstream pressure-rupturable seal covering the downstream opening; and a plurality of payloads each comprising a solid, dissolvable material, each of the plurality of payloads disposed in one of the plurality of payload chambers and configured to be deployed into the wellbore;

wherein each upstream pressure-rupturable seal of the plurality of payload chambers has a unique pressure rating for rupturing upon application of a unique pressure thereto, and wherein each downstream pressure-rupturable seal has an equal pressure rating for rupturing upon application of the same pressure thereto;

wherein each of the plurality of payloads is formed as a solid capsule comprising the solid, dissolvable material and a chemical marker.

2. The payload deployment tool of claim 1, wherein the coupler includes internal threads.

3. The payload deployment tool of claim 1, wherein each of the plurality of payload chambers is a cylindrical chamber having a longitudinal axis that extends parallel to a longitude of the tool.

4. The payload deployment tool of claim 1, wherein the housing further comprising a fluid passage in communication with the pressure chamber and spaced from the outer surface.

5. The payload deployment tool of claim 4, wherein the fluid passage extends longitudinally from the pressure chamber to the distal end of the housing.

6. The payload deployment tool of claim 1, wherein each of the downstream pressure-rupturable seals has a pressure rating lower than all of the pressure ratings of the upstream pressure-rupturable seals.

7. The payload deployment tool of claim 1, wherein each of the chemical markers is a unique chemical marker.

8. The payload deployment tool of claim 7, wherein the solid, dissolvable material comprises one selected from the group of carbon, solid polylactic acid material, and a soap stick comprising a surfactant.

9. The payload deployment tool of claim 1, wherein each of the upstream pressure-rupturable seals comprises a material selected from the group of stainless steel, carbon steel, nickel, nickel alloys, aluminum, tantalum, Hastelloy, graphite, and Monel.

10. The payload deployment tool of claim 9, wherein a thickness of each upstream pressure-rupturable seal is between about 0.001 inches to 0.1 inches.

* * * * *